US009115970B2

(12) United States Patent
DeVries et al.

(10) Patent No.: US 9,115,970 B2
(45) Date of Patent: Aug. 25, 2015

(54) HIGH VOLTAGE FIRING UNIT, ORDNANCE SYSTEM, AND METHOD OF OPERATING SAME

(75) Inventors: Derek R. DeVries, Farr West, UT (US); Brent D. Madsen, Providence, UT (US); Eldon C. Peterson, North Logan, UT (US); Donald L. Jackson, West Jordan, UT (US); William W. Thorup, West Jordan, UT (US); Scott K. Lusk, Cameron Park, CA (US)

(73) Assignee: ORBITAL ATK, INC., Dulles, VA (US)

( * ) Notice: Subject to any disclaimer, the term of this patent is extended or adjusted under 35 U.S.C. 154(b) by 293 days.

(21) Appl. No.: 13/608,571

(22) Filed: Sep. 10, 2012

(65) Prior Publication Data

US 2015/0192397 A1 Jul. 9, 2015

(51) Int. Cl.
*F42C 15/40* (2006.01)
*F42D 1/045* (2006.01)

(52) U.S. Cl.
CPC ..... *F42C 15/40* (2013.01); *F42D 1/045* (2013.01)

(58) Field of Classification Search
CPC ..... F42C 15/40; B64G 1/645; F42D 1/045; F42D 1/055
USPC ..... 102/206, 218; 89/1.14
See application file for complete search history.

(56) References Cited

U.S. PATENT DOCUMENTS 3,921,067 A 11/1975 Mernone et al.
4,541,341 A * 9/1985 Fowler et al. ..... 102/215
4,586,437 A 5/1986 Miki et al.
4,602,565 A 7/1986 MacDonald et al.
4,635,552 A 1/1987 Battle
5,070,789 A 12/1991 True et al.
5,291,829 A * 3/1994 Avory et al. ..... 102/202.2
5,341,742 A * 8/1994 Alford et al. ..... 102/202.8
5,436,791 A 7/1995 Turana et al.
5,444,598 A 8/1995 Aresco
5,476,044 A * 12/1995 Boucher ..... 102/218
5,756,926 A * 5/1998 Bonbrake et al. ..... 102/215
5,912,428 A 6/1999 Patti
6,584,907 B2 7/2003 Boucher et al.
6,634,298 B1 10/2003 Denney (Continued)

OTHER PUBLICATIONS

International Search Report for International Application No. PCT/US2013/058889, dated May 23, 2014, 5 pages.

(Continued)

*Primary Examiner* — Bret Hayes
(74) *Attorney, Agent, or Firm* — TraskBritt

(57) ABSTRACT

A high voltage firing unit may comprise a high voltage converter, a capacitive discharge unit, and a control unit. The high voltage converter may be configured to generate a high voltage output signal from a lower voltage input signal. The capacitive discharge unit may be configured to store energy from the high voltage output signal across an energy storage device, and to discharge energy from the energy storage device in response to a fire control signal. The control unit operably may be configured to communicate with an external ordnance controller and control internal operations of the high voltage firing unit. An ordnance system, may comprise a high voltage firing unit and an ordnance controller configured to communicate data with the control unit and at least one power signal to the high voltage converter. A method for operating a high voltage firing unit is also disclosed.

26 Claims, 4 Drawing Sheets

(56) References Cited

U.S. PATENT DOCUMENTS

| | | | | |
|---|---|---|---|---|
| 6,718,881 | B2 | 4/2004 | Rauscher, Jr. | |
| 6,889,610 | B2 | 5/2005 | Boucher et al. | |
| 6,992,877 | B2 | 1/2006 | DeVries et al. | |
| 7,261,028 | B2 | 8/2007 | Devries et al. | |
| 7,301,750 | B2 | 11/2007 | DeVries et al. | |
| 7,613,963 | B1 | 11/2009 | Pylant et al. | |
| 8,582,275 | B2 * | 11/2013 | Yan et al. | 361/248 |
| 8,863,665 | B2 | 10/2014 | DeVries et al. | |
| 2005/0178282 | A1 * | 8/2005 | Brooks et al. | 102/202.7 |
| 2009/0114110 | A1 * | 5/2009 | Devries et al. | 102/254 |
| 2010/0005994 | A1 * | 1/2010 | Jacobson et al. | 102/215 |
| 2011/0277620 | A1 | 11/2011 | Havran et al. | |
| 2012/0227608 | A1 * | 9/2012 | Givens et al. | 102/311 |
| 2014/0000470 | A1 * | 1/2014 | Biggs et al. | 102/215 |

OTHER PUBLICATIONS

Written Opinion of the International Searching Authority for International Application No. PCT/US2013/058889, dated May 23, 2014, 4 pages.

* cited by examiner

HIGH VOLTAGE FIRING UNIT, ORDNANCE SYSTEM, AND METHOD OF OPERATING SAME

STATEMENT REGARDING FEDERALLY SPONSORED RESEARCH OR DEVELOPMENT

The U.S. Government has a paid-up license in this invention and the right in limited circumstances to require the patent owner to license others on reasonable terms as provided for by the terms of Contract Nos. FA9300-06-D-0004 awarded by the Air Force, and N00164-05-C-4502 awarded by the Navy.

CROSS REFERENCE TO RELATED APPLICATION

This application is a related to U.S. patent application Ser. No. 13/608,824 entitled "Distributed Ordnance System, Multiple-Stage Ordnance System, and Related Methods," filed on the same day as the present application, the disclosure of which is hereby incorporated by reference in its entirety.

FIELD

The disclosure relates generally to firing units used for launch vehicle and munitions systems. More specifically, the disclosure relates to high voltage firing units for initiating energetic materials.

BACKGROUND

Firing units employed in weapon systems, aerospace systems, and other systems often include an electronics assembly and an initiation device. A firing unit containing an electronics assembly and an initiator/detonator may be utilized to initiate downstream energetic materials. Energetic materials, such as explosive materials, pyrotechnic materials, propellants and fuels, may be initiated with a variety of different types of energy including heat, chemical, mechanical, electrical, or optical. For example, energetic materials may be ignited by flame ignition (e.g., fuzes or ignition of a priming explosive), impact (which often ignites a priming explosive), chemical interaction (e.g., contact with a reactive or activating fluid), or electrical ignition. Electrical ignition may occur in one of at least two ways. For example, a bridge element may be heated until auto ignition of the adjacent energetic material occurs, or the bridge element may be exploded by directly detonating the adjacent energetic material. Providing a proper signal structure may cause a firing unit to initiate a pyrotechnic or explosive charge, which may then activate an ordnance device for a specific motor event. These motor events may include motor initiation, stage separation, thrust vector control activation, payload faring ejection and separation, etc.

A firing unit may include an energetic material secured within a housing, an initiation device configured to ignite the energetic material, and an electronics assembly electrically connected to the initiation device. Conventional firing units generally consume large amounts of energy and therefore require large batteries to operate. Furthermore, conventional firing units may be susceptible to inadvertent activation due to stray energy in the surrounding environment. Special precaution must be taken in the implementation of the firing unit and integrated initiator or detonator to control the affects of the environment in order to minimize the probability of an inadvertent initiation. The electronics assembly may prevent firing of the initiator/detonator until armed, communicates with the upstream electrical system, and upon receipt of a proper firing signal delivers the correct current pulse to the initiator bridge element. An electrical initiator/detonator may incorporate, in a sealed housing, an electrical connection to the electronics assembly, the bridge element, and the energetic material. The firing unit may be used to initiate rocket motor igniters, pressure cartridges, detonating cords, destruct charges, separation charges, payload release mechanisms, power system, warheads, gas generators, etc. These firing units may be employed in weapon systems (tactical and strategic for both ground and flight operations), aerospace systems (e.g., space launch vehicles, aircraft emergency egress), automotive airbag deployment systems, airdrop systems (e.g., parachute deployment, severance), mining and demolition systems, etc.

DETAILED DESCRIPTION

Figure 1:
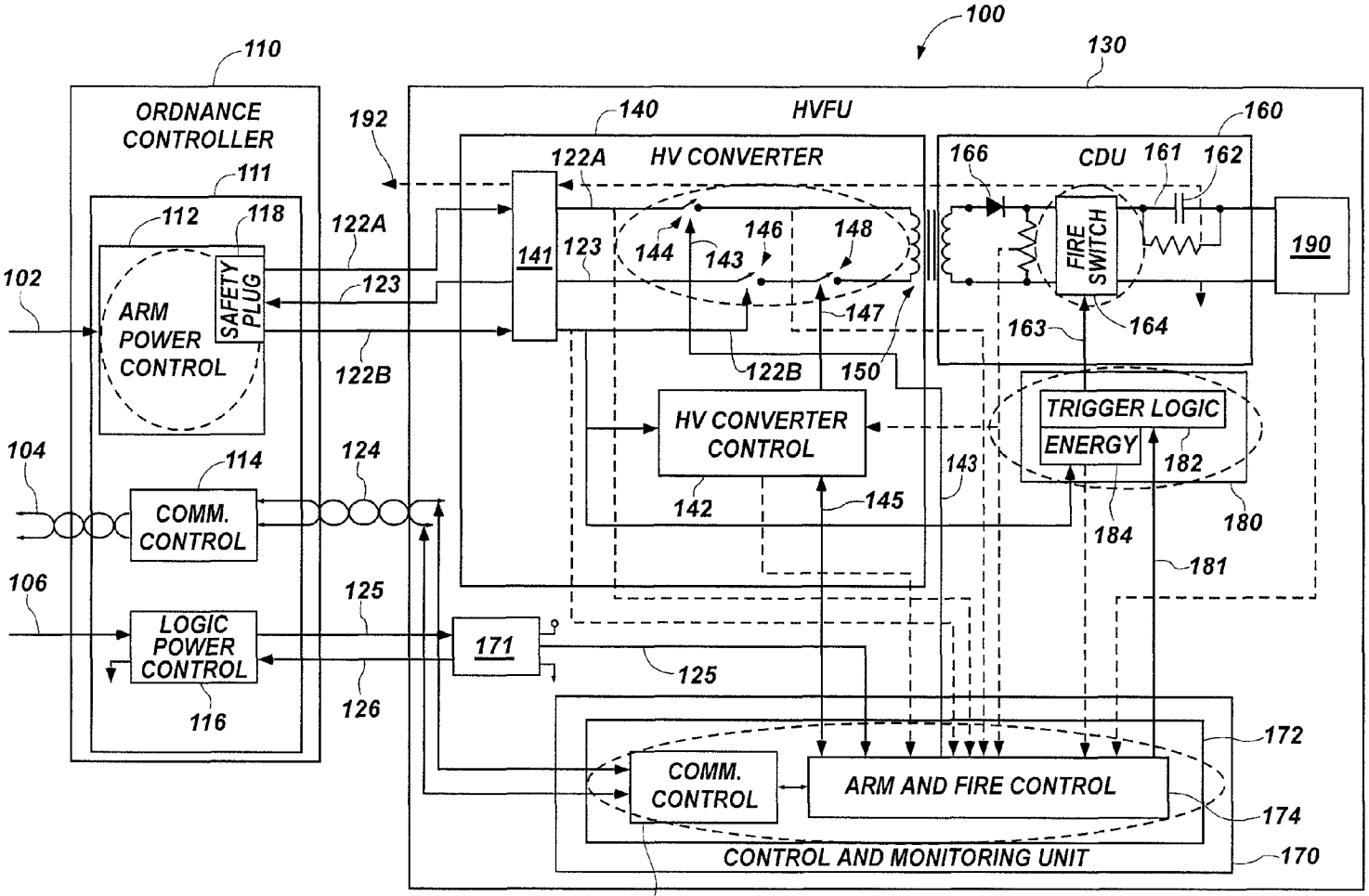
FIG. 1 is a schematic block diagram of an ordnance system according to an embodiment of the present disclosure.

In the following description, reference is made to the accompanying drawings in which is shown, by way of illustration, specific embodiments of the present disclosure. Other embodiments may be utilized and changes may be made without departing from the scope of the disclosure. The following detailed description is not to be taken in a limiting sense, and the scope of the claimed invention is defined only by the appended claims and their legal equivalents.

Furthermore, specific implementations shown and described are only examples and should not be construed as the only way to implement or partition the present disclosure into functional elements unless specified otherwise herein. It will be readily apparent to one of ordinary skill in the art that the various embodiments of the present disclosure may be practiced by numerous other partitioning solutions.

In the following description, elements, circuits, and functions may be shown in block diagram form in order not to obscure the present disclosure in unnecessary detail. Additionally, block definitions and partitioning of logic between various blocks is exemplary of a specific implementation. It will be readily apparent to one of ordinary skill in the art that the present disclosure may be practiced by numerous other partitioning solutions. Those of ordinary skill in the art would understand that information and signals may be represented using any of a variety of different technologies and techniques. For example, data, instructions, commands, information, signals, bits, symbols, and chips that may be referenced throughout the above description may be represented by voltages, currents, electromagnetic waves, magnetic fields or particles, optical fields or particles, or any combination thereof. Some drawings may illustrate signals as a single signal for clarity of presentation and description. It will be understood by a person of ordinary skill in the art that the signal may represent a bus of signals, wherein the bus may have a variety of bit widths and the present disclosure may be implemented on any number of data signals including a single data signal.

The various illustrative logical blocks, modules, and circuits described in connection with the embodiments disclosed herein may be implemented or performed with a general-purpose processor, a special-purpose processor, a Digital Signal Processor (DSP), an Application-Specific Integrated Circuit (ASIC), a Field-Programmable Gate Array (FPGA) or other programmable logic device, a controller, discrete gate or transistor logic, discrete hardware components, or any combination thereof designed to perform the functions described herein. A general-purpose processor may be a microprocessor, but in the alternative, the processor may be any conventional processor, controller, microcontroller, or state machine. A general-purpose processor may be considered a special-purpose processor while the general-purpose processor executes instructions (e.g., software code) stored on a computer-readable medium. A processor may also be implemented as a combination of computing devices, such as a combination of a DSP and a microprocessor, a plurality of microprocessors, one or more microprocessors in conjunction with a DSP core, or any other such configuration.

Also, it is noted that the embodiments may be described in terms of a process that may be depicted as a flowchart, a flow diagram, a structure diagram, or a block diagram. Although a process may describe operational acts as a sequential process, many of these acts can be performed in another sequence, in parallel, or substantially concurrently. In addition, the order of the acts may be re-arranged. A process may correspond to a method, a function, a procedure, a subroutine, a subprogram, etc. Furthermore, the methods disclosed herein may be implemented in hardware, software, or both. If implemented in software, the functions may be stored or transmitted as one or more instructions or code on computer readable media. Computer-readable media includes both computer storage media and communication media, including any medium that facilitates transfer of a computer program from one place to another.

It should be understood that any reference to an element herein using a designation such as "first," "second," and so forth does not limit the quantity or order of those elements, unless such limitation is explicitly stated. Rather, these designations may be used herein as a convenient method of distinguishing between two or more elements or instances of an element. Thus, a reference to first and second elements does not mean that only two elements may be employed or that the first element must precede the second element in some manner. In addition, unless stated otherwise, a set of elements may comprise one or more elements.

FIG. 1 is a schematic block diagram of an ordnance system 100 according to an embodiment of the present disclosure. The ordnance system 100 includes an ordnance controller 110 and a high voltage firing unit (HVFU) 130, which may be coupled together for communication therebetween. The ordnance system 100 may further include an initiator 190 that couples with the HVFU 130. The HVFU 130 may be configured to energize the initiator 190 for the initiator 190 to produce an output to initiate a downstream energetic material in an ordnance device (not shown). Such ordnance devices include but are not limited to ignition devices, exploding bolts, actuators, gas generators, separation devices, pressure equalization and ventilation devices, individually and collectively referred to hereinafter as "ordnances."

The initiator 190 is shown in FIG. 1 as being located within the box designating the HVFU 130; however, the initiator 190 may be housed separately from the electronics assembly (FIG. 3), and may be detachably connected with connectors, such as mating connectors, stripline cables, etc. The initiator 190 may be configured as an ignition and/or detonation device, such as an exploding foil initiator or an exploding foil detonator. As specific, non-limiting examples, the initiator 190 may comprise one or more of a slapper detonator, an exploding foil initiator (EFI), a low-energy exploding foil initiator (LEEFI) an exploding foil detonator (EFD), a blasting cap, an exploding-bridgewire detonator (EBW), an instantaneous electrical detonator (IED), a short period delay detonator (SPD), and a long period delay detonator (LPD).

The ordnance controller 110 may include control logic 111 configured to control and communicate various signals with the various features of the HVFU 130. Such control logic 111 may be embodied within one or more processors. The HVFU 130 and the ordnance controller 110 may be coupled together to transmit communication data 124 therebetween with via a communication bus. The ordnance controller 110 may be configured to transmit a plurality of additional signals to the HVFU 130, such as electronic safe arm (ESA) power signals 122A, 122B, and a logic power signal 125. The ordnance controller 110 may also receive signals from the HVFU 130, such as communication data 124, as well as power return signals 123, 126. The power return signals 123, 126 may be reference lines (e.g., ground line, a biased reference, etc.) coming back from the HVFU 130 in order to have proper ground control. The ESA power signals 122A, 122B may be separate from the logic power signal 125, and the power return signals 123, 126 may be separate from each other as well. This separation may assist in embodiments that include the control and monitoring unit 170 and a HV converter 140 being electrically isolated from each other. As a result, transients may be reduced between the HV converter 140 and a control and monitoring unit 170.

The control logic 111 of the ordnance controller 110 may be configured to perform functions such as arm power control 112, communication control 114, and logic power control 116. The arm power control 112 may generate the ESA power signals 122A, 122B responsive to an input signal 102. The ESA power signals 122A, 122B may provide power to the HVFU 130 to be converted to generate an HV output signal 161 that is provided to the initiator 190. The voltages of the ESA power signals 122A, 122B may be a relatively low voltage (e.g., between 22V and 45V) prior to being converted to a higher voltage (e.g., above 500V) by the HVFU 130. The communication control 114 may be configured to control communication data 124 on the communication bus between the ordnance controller 110 and one or more HVFUs 130. The logic power control 116 may be configured to generate the logic power signal 125 responsive to another input signal 106. The logic power signal 125 may provide power to the control and monitoring unit 170 of the HVFU 130. The logic power signal 125 may filtered, monitored, voltage regulated, and/or transient protected as they pass through an input filter 171 of the HV converter 140.

The arm power control 112 may further include a safety plug 118 that may be used to physically disconnect the ESA power signals 122A, 122B so that power may not be provided to the HVFU 130 for charging. The arm power control 112 may further perform an environmental sense determination prior to transmitting the ESA power signals 122A, 122B. An environmental sense determination may include sensing environmental information (e.g., acceleration, motor pressure, etc.) prior to transmitting the ESA power signals 122A, 122B. As a result, the additional requirement that acceleration is determined prior to arming the HVFU 130 may be another desirable safety precaution for ordnances on a tactical system for flight.

The HVFU 130 may include a high voltage (HV) converter 140, a capacitive discharge unit (CDU) 160, a control and monitoring unit 170, and a trigger unit 180. The HV converter 140, the CDU 160, the control and monitoring unit 170, and the trigger unit 180 may be inter-coupled to send and receive various signals (e.g., control signals, feedback signals, monitoring signals, power signals, etc.) for assisting in the performance of the various functions and operations described herein.

The HV converter 140 may be configured to generate a high output voltage in response to one or more low voltage signals. For example, the first ESA power signal 122A may provide an input voltage to the HV converter 140. The second ESA power signal 122B may be used as a control signal for a second safety switch 146 that will be described in more detail below. The ESA power signals 122A, 122B may also be filtered, monitored, voltage regulated, and/or transient protected as they pass through an input filter 141 of the HV converter 140. For example, the first ESA power signal 122A may provide a low DC voltage (e.g., between 22V and 45V) to the HV converter 140. The HV converter 140 may convert the low DC voltage into a high voltage (e.g., above 500V) through a transformer 150. The transformer 150 may be configured as a flyback transformer.

The HV converter 140 may further include a plurality of safety switches 144, 146, 148 operably coupled in the path to the transformer 150, and which are configured to operate as electronic safety inhibits for the HV converter 140. As a result, disabling the any one of the plurality of safety switches 144, 146, 148 may disable the charging of an energy storage device 162 of the CDU 160 with the HV output signal 161. More or fewer safety inhibits may be present depending on the desired level of safety and redundancy in the safety inhibits. An example of an arming sequence for activating the safety inhibits (e.g., the plurality of safety switches 144, 146, 148) will be described below with respect to FIG. 2A.

The first safety switch 144 and the second safety switch 146 may be static switches. In other words, the first safety switch 144 and the second safety switch 146 may be enabled one time based on certain conditions being met and may remain on until they are disabled. For example, the first safety switch 144 may coupled in the path of the first ESA power signal 122A to the transformer 150. The first safety switch 144 may be controlled by a first control signal 143 generated by the control and monitoring unit 170. The second safety switch 146 may be coupled in the path of the power return signal 123 (e.g., ground) to the transformer 150. The second switch may be controlled by the second ESA power signal 122B acting as a second control signal. The third safety switch 148 may be a dynamic switch. In other words, the third safety switch 148 may be repeatedly enabled and disabled during operation of the HVFU 130 under control of a third control signal 147 generated by a HV converter control 142. The third safety switch 148 may be controlled to pulse the charging of the energy storage device 162 in the CDU 160 with the HV output signal 161. In operation, the transformer 150 passes energy from a first coil to a second coil in response to current passing through the first coil. As a result, the HV converter 140 is configured to receive the first ESA power signal 122A and generate an HV output signal 161 to the CDU 160. In addition, the transformer 150 enables the HV converter 140 to be electrically isolated from the CDU 160.

The CDU 160 may include one or more energy storage devices 162 (e.g., capacitor) operably coupled with a fire switch 164. The energy storage device 162 may be configured to store energy for the HV output signal 161 to be provided to the initiator 190. The CDU 160 may further include a diode 166 coupled in the path between the transformer 150 and the energy storage device 162, such that a current backflow from the energy storage device 162 may be reduced. A feedback signal to the HV converter control 142 may cause the HV converter 140 to stop charging the energy storage device 162 if the desired maximum output voltage is reached. A small amount of current may leak over time, and in such a case, the HV converter 140 may recharge the energy storage device 162 in response to the HV output signal 161 falling below a predefined threshold in order to maintain the HV output signal 161 at a desired voltage level. When the HV output signal 161 has a voltage across the energy storage device 162 that reaches a sufficient level, the CDU 160 may be armed and ready to discharge the energy stored in the energy storage device 162 to energize the initiator 190.

The fire switch 164 may be configured to discharge the energy storage device 162 responsive to a fire control signal 163 from the trigger unit 180. Thus, the fire switch 164 may include an electronic fire control switch that provides an appropriate pulse discharge energy at the proper time to activate the initiator 190. For example, the fire switch 164 may include an electronic switch, a gap tube, and/or a triggered gap tube. Specific types of such switches may include a thyristor (e.g., n-channel MOS-controlled thyristor (NMCT)), an insulated gate bipolar transistor (IGBT), and other similar electronic devices.

The control and monitoring unit 170 communicates with the HV converter 140 and the CDU 160. The control and monitoring unit 170 may generate control signals 143, 145, and 181 to control and/or enable various functions described herein. For example, as previously discussed, the control and monitoring unit 170 may generate first control signal 143 to enable the first safety switch 144. The control and monitoring unit 170 may also generate the HV converter enable control signal 145 that indicates that the HV converter control 142 may begin to transmit the third control signal 147 operating the dynamic third safety switch 148 and pulse the charging of the energy storage device 162 in the CDU 160 with the HV output signal 161. As a result, the control and monitoring unit 170 may perform the timing and sequencing for arming the HVFU 130, as well as for enabling the HV converter control 142 for charging the HVFU 130. The control and monitoring unit 170 may further generate a trigger control signal 181 to the trigger unit 180 to initiate discharge of the energy storage device 162 and energize the initiator 190. As a result, the control and monitoring unit 170 may perform the timing for firing the HVFU 130.

The control and monitoring unit 170 may include control logic 172 that includes arm and fire control 174 and communication control 176. The communication control 176 may be configured to control communication data 124 transmitted between the HVFU 130 and the ordnance controller 110. The arm and fire control 174 may be configured to control the timing and sequencing for arming and firing the HVFU 130. The arm and fire control 174 may further be configured to monitor various signals of the HVFU 130. Such signals may be monitored as part of a built-in test (BIT) operation of the HVFU 130. Monitored signals (e.g., various voltage levels, current levels, etc.) are shown in FIG. 1 as dashed lines, and are not individually discussed. A BIT operation may be performed during power up of the HVFU 130 to determine the health and safety of the HVFU 130. A BIT operation may also be performed during operation of the HVFU 130 and provide status updates to the ordnance controller 110 (e.g., either automatically or upon request). If the control and monitoring unit 170 determines that one or more of the systems (e.g., HV converter 140, CDU 160, control and monitoring unit 170, trigger unit 180, initiator 190) has experienced a critical failure, the control and monitoring unit 170 and/or the ordnance controller 110 may "safe" the ordnance system 100 (e.g., by disabling safety inhibits, disconnecting power, etc.).

The trigger unit 180 may include trigger logic 182 and an energy storage device 184. The trigger logic 182 may include one or more switches configured to receive the trigger control signal 181 and generate the fire control signal 163 in response thereto. The trigger logic 182 may be configured to be single fault tolerant, in that the trigger logic 182 may include a plurality of components such that a single component failure does not activate the fire switch 164. For example, the trigger logic 182 may include two switches (e.g., FETs), and the trigger control signal 181 may include two control signals (e.g., one high and one low) that are used to activate the trigger logic 182 and generate the fire control signal 163. The energy storage device 184 of the trigger unit 180 may include one or more capacitors for providing a low impedance path between the trigger logic 182 and the gate of the fire switch 164, the result of which is that the fire control signal 163 used to activate the fire switch 164 may exhibit a relatively fast rise pulse.

The HVFU 130 may further include an HV output monitor signal 192. The HV output monitor signal 192 may be coupled to the output of the CDU 160 for providing an independent measurement of the energy status of the CDU 160. For example, an external monitor (not shown) may be connected to the HVFU 130 to receive the HV output monitor signal 192 to determine if there is energy present, and if so, what the value of the energy measurement is. Such information may be useful during a static test in order to determine if the HVFU 130 is safe with little, to no stored energy present. Such information may also be useful during operation of the HVFU for redundancy of information with other information already being collected by the control and monitoring unit 170.

Figure 2A:
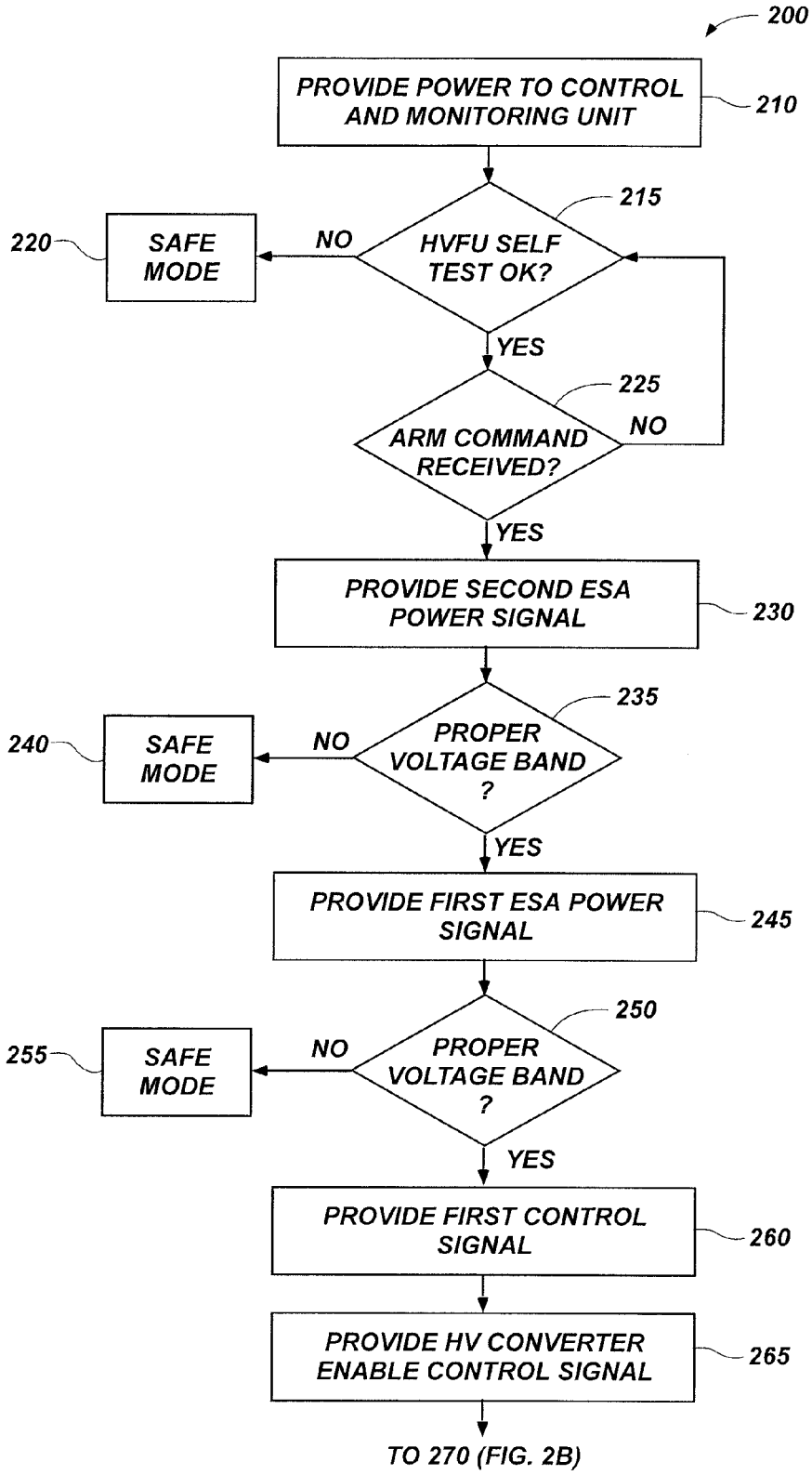
FIGS. 2A and 2B show a flow chart illustrating a method for operating an high voltage firing unit (HVFU) according to an embodiment of the present disclosure.
Figure 2B:
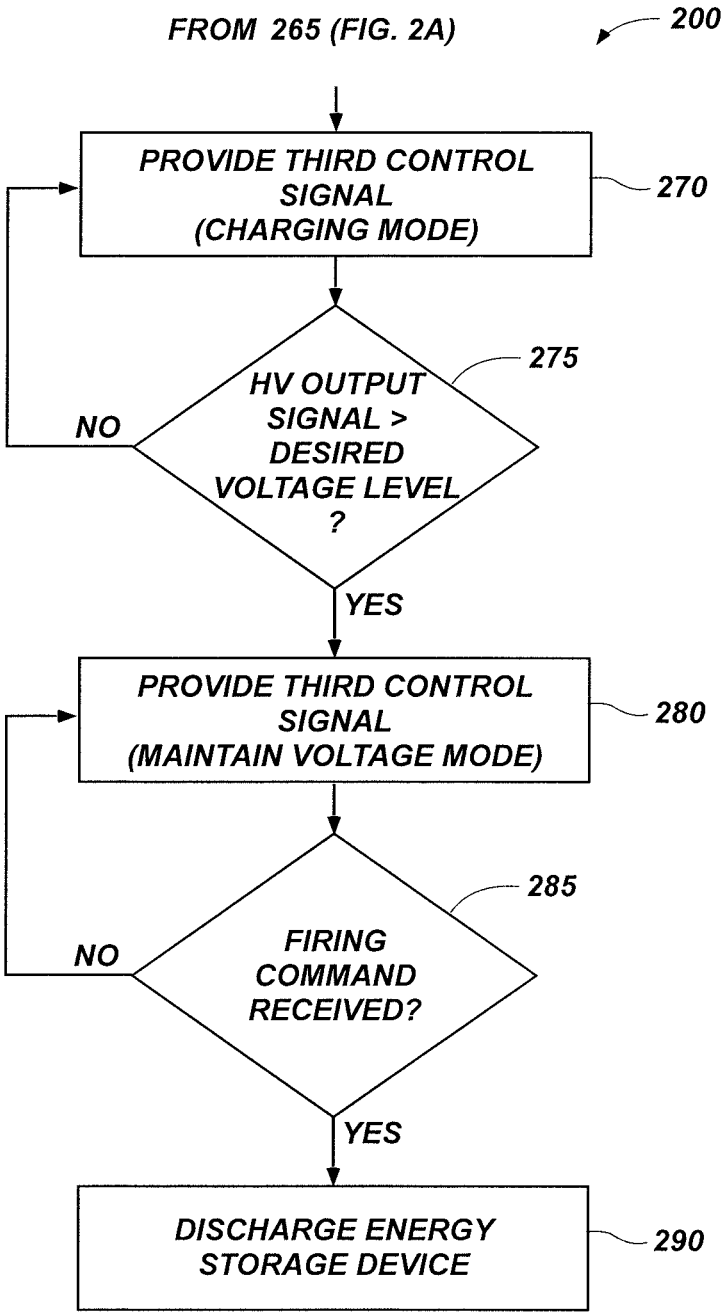

FIGS. 2A and 2B show a flow chart 200 illustrating a method for operating an HVFU according to an embodiment of the present disclosure. In particular, the flow chart 200 illustrates methods for arming, charging, and firing an HVFU. Throughout the description of the various operations of FIGS. 2A and 2B, reference will be made to the components of the ordnance system 100 of FIG. 1.

At operation 210, power may be provided to the control and monitoring unit 170. For example, the ordnance controller 110 may provide the logic power signal 125 to the HVFU 130. At power up, the control and monitoring unit 170 may perform a self test (i.e., BIT) of the HVFU 130 by reading in the monitoring signals (dashed lines) for determining if any stray voltages or currents exist at various nodes throughout the HVFU 130. The self test may further include a test of logic components, such as processors. For example, the control and monitoring unit 170 may test that a processor properly performs reads, writes, arithmetic operations, etc.

At operation 215, a decision may be made regarding whether the HVFU self test is successful. If the HVFU self test is not successful, then the HVFU may enter (or remain) in a safe mode, at operation 220. That is, the plurality of switches of the HV converter 140 acting as safety inhibits may remain disabled, power may be disconnected to the HVFU 130, or other safety precautions may be taken. If HVFU self test is successful, the control and monitoring unit 170 may report back to the ordnance controller 110 that the HVFU 130 is determined to initially be operating correctly.

At operation 225, the ordnance system 100 may wait for an arm command before initiating additional operations of an arming sequence. In other words, the ordnance controller 110 and the control and monitoring unit 170 may wait for an arm command to be received by the ordnance system 100 before the plurality of safety switches 144, 146, 148 are enabled to arm the HVFU 130. If the arm command is not received, the control and monitoring unit 170 may continue to monitor certain monitor signals to ensure continued safety of the HVFU 130. An arm command may be received from the host through communication data 104 into the ordnance controller 110. A system may include a plurality of HVFUs 130 that may be individually addressable. As a result, the arm command may include an address to indicate which HVFU 130 is to be armed. If such an arm command is received (and the address matches the HVFU 130), the ordnance controller 110 and the control and monitoring unit 170 of the appropriate HVFU 130 may initiate an arming sequence for the HVFU 130.

For example, at operation 230, the ordnance controller 110 may send the second ESA power signal 122B to the HVFU 130. The second ESA power signal 122B may be received at the gate of the second safety switch 146 of the HV converter 140. As discussed above, the second safety switch 146 may be a static switch that is enabled as long as the second ESA power signal 122B is asserted. The second ESA power signal 122B may also be received by the control and monitoring unit 170.

At operation 235, the control and monitoring unit 170 may verify whether or not the second ESA power signal 122B is within a proper voltage band (e.g., desired voltage ±some tolerance). If the second ESA power signal 122B has a voltage level that is outside the proper voltage band, the HVFU 130 may enter (or remain) in a safe mode at operation 240. That is, the plurality of switches of the HV converter 140 acting as safety inhibits may be disabled (or remain disabled as the case may be), power may be disconnected to the HVFU 130, or other safety precautions may be taken. If the second ESA power signal 122B has a voltage level that is within the proper voltage band, the first ESA power signal 122A may be sent to the HVFU 130 from the ordnance controller 110, at operation 245. The first ESA power signal 122A may also be received by the control and monitoring unit 170.

At operation 250, the control and monitoring unit 170 may verify whether or not the first ESA power signal 122A is within a proper voltage band (e.g., desired voltage ±some tolerance). If the first ESA power signal 122A has a voltage level that is outside the proper voltage band, the HVFU 130 may enter (or remain) in a safe mode at operation 255. That is, the plurality of switches of the HV converter 140 acting as safety inhibits may be disabled (or remain disabled as the case may be), power may be disconnected to the HVFU 130, or other safety precautions may be taken. If the first ESA power signal 122A has a voltage level that is within the proper voltage band, the control and monitoring unit 170 may send the first control signal 143 to the gate of the first safety switch 144, at operation 260. As discussed above, the first safety switch 144 may be a static switch that is enabled as long as the first control signal 143 is asserted. At operation 265, the control and monitoring unit 170 may send an HV converter enable control signal 145 that indicates that the HV converter control 142 may begin to transmit the third control signal 147 operating the dynamic third safety switch 148 and pulse the charging of the energy storage device 162 in the CDU 160 with the HV output signal 161. In other words, with each switch of the plurality of safety switches 144, 146, 148 enabled and operating, the HVFU 130 is in an armed state and may begin charging the energy storage device 162 to become ready to fire.

FIG. 2B is a continuation of the flow chart 200 described in FIG. 2A for operating the HVFU 130 according to an embodiment of the present disclosure. In particular, the operations shown in FIG. 2B may include those operations associated with the charging and firing operations of the HVFU 130. As such, it is presumed that the HVFU 130 is armed, such as, for example, through operations 210 through 265.

At operation 270, the HV converter control 142 may generate the third control signal 147 to control the third safety switch 148 and operate a charging mode for charging the energy storage device 162. As discussed above, the third safety switch 148 is a dynamic switch. At operation 275, the HV converter control 142 may monitor a voltage level for the HV output signal 161 to determine if the HV output signal 161 has properly reached the desired voltage level. If not, the charging mode may continue. If so, at operation 280, the HV converter control 142 may generate the third control signal 147 to control the third safety switch 148 and operate a maintain voltage mode for maintaining the voltage level of the HV output signal 161 at the desired voltage level. The HV converter control 142 may continue to monitor the voltage level for the HV output signal 161 to determine if the HV output signal 161 has dropped below the desired voltage level and adjusts the third control signal 147 accordingly.

At this point, the HVFU 130 may be armed and ready to fire. The maintenance mode may be configured to maintain the voltage at approximately the desired level for firing until discharge of the energy storage device 162 or until the HVFU 130 enters a safe mode (e.g., if a problem is detected, if a manual safe command is given, if power is shut off, etc.).

At operation 285, if the firing command is received, the energy stored on the energy storage device 162 may be discharged (operation 290) to the initiator 190. For example, the control and monitoring unit 170 may send the trigger control signal 181 to the trigger unit 180, which may further generate the fire control signal 163 to enable the fire switch 164.

Figure 3:
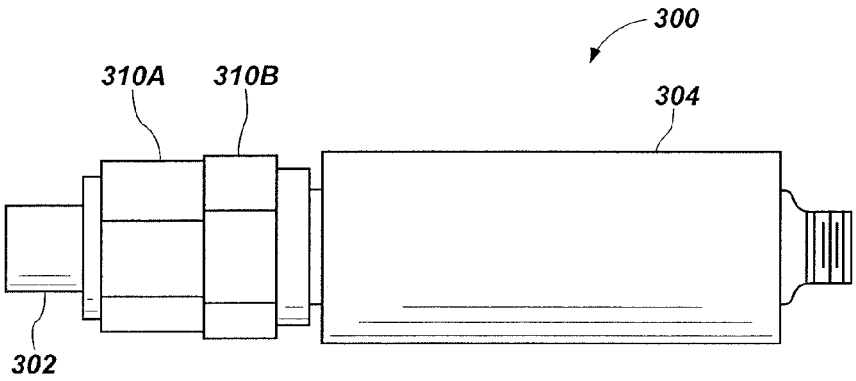
FIG. 3 is a side view of an HVFU assembly according to an embodiment of the present disclosure.

FIG. 3 is a side view of an HVFU assembly 300 according to an embodiment of the present disclosure. The HVFU assembly 300 may include an initiation device 302 and an electronics assembly 304. The initiation device 302 may house the initiator 190 (FIG. 1), and the electronics assembly 304 may house the electronics of the HVFU 130 (FIG. 1), each of which are discussed above. In some embodiments, the HVFU assembly 300 is a firing unit that generates output voltages having relatively large voltage levels, such as greater than 500V, and in some embodiments, even greater than 1000V. The HVFU assembly 300 may be employed in applications where pressures may be within a range from ambient pressure to vacuum pressure, where temperatures may be within a range from −65° C. to 85° C., and where extreme mechanical vibrations and mechanical shocks may occur.

The initiation device 302 and the electronics assembly 304 may be connected together with one or more mating connectors 310A, 310B. For example, assembling such an HVFU assembly 300 may include at least partially inserting a portion of a first mating connector 310A of the initiation device 302 into another portion of a second mating connector 310B of the electronics assembly 304. As a result an electrical interface (not shown) of the first mating connector 310A may be directly electrically connected to an electrical interface (not shown) of the second mating connector 310B of the electronics assembly 304. As a result, the initiation device 302 may be removably connected to the electronics assembly 304. If the initiation device 302 is detachable from the electronics assembly 304, such separation may enable safe handling of the separated initiation device 302 and the electronics assembly 304, such as for transport or testing of the components of the HVFU assembly 300. Additional embodiments for connecting the electronics assembly 304 with the initiation device 302 may include direct connections between the two assemblies rather than using discrete mating connectors, as well as connections using cables for a greater distance therebetween. Examples of such connections are described in further detail in U.S. patent application Ser. No. 13/348,485, filed on Jan. 11, 2012, and entitled "Connectors for Separable Firing Unit Assemblies, Separable Firing Unit Assemblies, and Related Methods," the disclosure of which is incorporated herein by this reference in its entirety.

Figure 4:
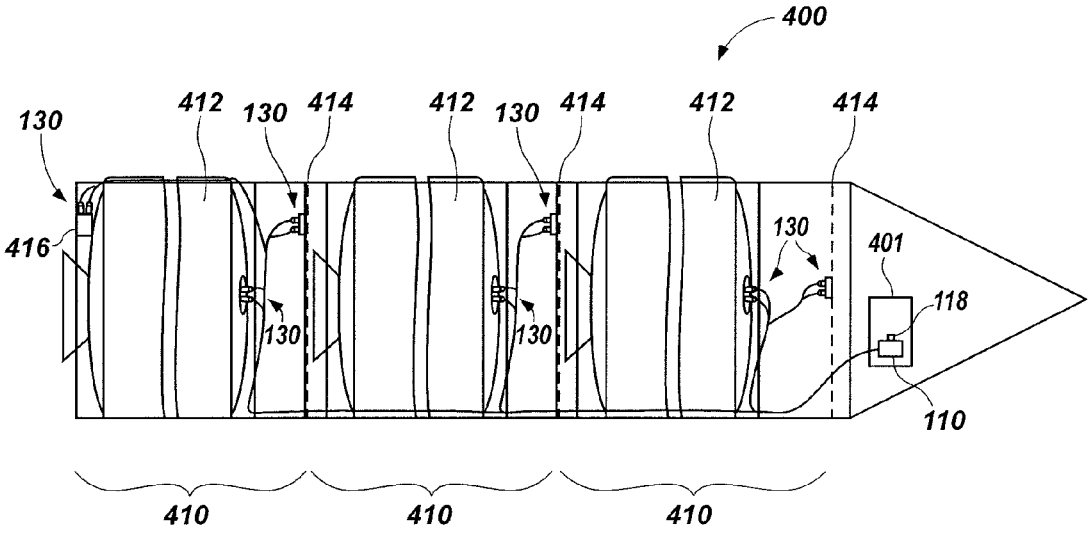
FIG. 4 is a cutaway side view of a rocket motor that includes an ordnance system including at least one HVFU according to an embodiment of the present disclosure.

FIG. 4 is a cutaway side view of a rocket motor 400 that includes an ordnance system including at least one HVFU according to an embodiment of the present disclosure. In particular, the rocket motor 400 is a multi-stage rocket motor. In other words, the rocket motor 400 includes a plurality of stages 410, each of which may include a propellant acting as a motor 412 for the respective stage 410. Each stage 410 may have one or more HVFUs 130, which may be used for igniting an energetic material to which it is associated, such as the motor 412, a separation joint 414 for separating the stages 410 after use of the stage 410 during flight, an energy device 416 (e.g., a battery, gas generator, etc.), or for other uses (e.g., a warhead for destruction). The HVFUs of the various stages 410 may be coupled with the ordnance controller 110. The ordnance controller 110 may be part of an avionics unit 401 of the rocket motor 400. The avionics unit 401 may manage flight controls for the rocket motor 400, such as thrust vector control (TVC) commands, collecting instrumentation data, etc. The avionics unit 401 may provide controls to the ordnance controller 110 for controlling which of the HVFU 130 are to be fired within the rocket motor 400. The HVFUs 130 may be individually addressable and controllable from the avionics unit 401 through the ordnance controller 110. As discussed above, the ordnance controller 110 may be configured to control generation of the ESA power signals 122A, 122B, such as in response to control signals during an aiming sequence.

The ordnance controller 110 may control HVFUs 130 for a plurality of stages 410, while in some embodiments, an ordnance system may include a plurality of ordnance controllers 110 that are distributed throughout the stages 410. Such an ordnance system is described in U.S. patent application Ser. No. 13/608,824, filed on the same day as the present application, and entitled "Distributed Ordnance System, Multiple-Stage Ordnance System, and Related Methods," the disclosure of which is incorporated herein by this reference in its entirety, as also described above. While reference is given to HVFUs being used within a rocket motor, other embodiments are also contemplated. For example, one or more HVFUs may be employed in a variety of applications, such as in mining, drilling, demolition, among other applications in which a firing unit may be used to ignite or otherwise initiate an initiator coupled to an energetic material.

CONCLUSION

In one embodiment, a high voltage firing unit is disclosed. The high voltage firing unit comprises a high voltage converter, a capacitive discharge unit, and a control unit. The high voltage converter is configured to generate a high voltage output signal from a lower voltage input signal. The capacitive discharge unit is operably coupled with the high voltage converter. The capacitive discharge unit is configured to store energy from the high voltage output signal across an energy storage device, and to discharge energy from the energy storage device in response to a fire control signal. The control unit operably is coupled with the high voltage converter and the capacitive discharge unit. The control unit is configured to communicate with an external ordnance controller and control internal operations of the high voltage firing unit.

In another embodiment, an ordnance system is disclosed. The ordnance system comprises a high voltage firing unit and an ordnance controller operably coupled with the high voltage firing unit. The high voltage firing unit comprises a high voltage converter configured to convert a low voltage signal to a high voltage output signal, a capacitive discharge unit configured to store energy from the high voltage output signal in one or more energy storage devices, and to discharge the energy responsive to a fire control signal, and a control unit configured to control internal operations of the high voltage firing unit. The ordnance controller is configured to communicate data with the control unit and at least one power signal to the high voltage converter.

In another embodiment, a method for operating a high voltage firing unit is disclosed. The method comprises arming a high voltage converter of a high voltage firing unit, charging a capacitive discharge unit of the high voltage firing unit by converting a low voltage input signal to a high voltage output signal and storing energy from the high voltage output signal in an energy storage device, and discharging the energy from the energy storage device to activate an initiator in response to a fire control signal.

While the present disclosure has been described herein with respect to certain illustrated embodiments, those of ordinary skill in the art will recognize and appreciate that the disclosure is not so limited. Rather, many additions, deletions, and modifications to the illustrated and described embodiments may be made without departing from the scope of the disclosure. In addition, features from one embodiment may be combined with features of another embodiment while still being encompassed within the scope of the disclosure as contemplated by the inventor. Finally, the scope of the claimed invention is defined only by the appended claims and their legal equivalents.

What is claimed is:

1. A high voltage firing unit, comprising:

a high voltage converter configured to generate a high voltage output signal from a lower voltage input signal, the lower voltage input signal being a first electronic safe arm (ESA) power signal from the external ordnance controller;

a capacitive discharge unit operably coupled with the high voltage converter, the capacitive discharge unit configured to store energy from the high voltage output signal across an energy storage device, and to discharge energy from the energy storage device in response to a fire control signal;

a control unit operably coupled with the high voltage converter and the capacitive discharge unit, the control unit configured to communicate with the external ordnance controller and control internal operations of the high voltage firing unit; and a plurality of safety switches coupled in a path to the capacitive discharge unit on a lower voltage side of the high voltage converter that is electrically isolated from the capacitive discharge unit, wherein the plurality of safety switches prevents charging of the energy storage device if any one of the plurality of safety switches is disabled during a safe mode, wherein a first safety switch is controllable to enable and disable the lower voltage input signal in the path to the capacitive discharge unit, and a second safety switch is controlled by a second ESA power signal from the external ordnance controller.

2. The high voltage firing unit of claim 1, wherein the control unit is configured to perform an internal test of a plurality of monitored signals internal to the high voltage firing unit.

3. The high voltage firing unit of claim 2, wherein the control unit is further configured to communicate a status from the internal test to the external ordnance prior to the external ordnance controller sending the first ESA power signal and the second ESA power signal.

4. The high voltage firing unit of claim 1, further comprising an initiator operably coupled with the capacitive discharge unit, wherein the discharged energy from the energy storage device energizes the initiator to ignite an energetic material associated with the initiator.

5. The high voltage firing unit of claim 4, further comprising:

an initiation device for housing the initiator; and an electronics assembly for housing the high voltage converter, the capacitive discharge unit, and the control unit, wherein the initiation device and the electronics assembly are detachably connected, wherein the initiator comprises at least one of a slapper detonator, an exploding foil initiator (EFI), a low-energy exploding foil initiator (LEEFI), an exploding foil detonator (EFD), a blasting cap, an exploding-bridgewire detonator (EBW), an instantaneous electrical detonator (IED), a short period delay detonator (SPD), and a long period delay detonator (LPD).

6. The high voltage firing unit of claim 1, wherein the plurality of safety switches includes at least one switch that is controlled by a control signal generated by the control unit.

7. The high voltage firing unit of claim 1, wherein the plurality of safety switches includes at least one switch that is controlled by a control signal generated by a high voltage control logic module within the high voltage converter.

8. The high voltage firing unit of claim 1, wherein the capacitive discharge unit further comprises a fire switch, wherein the fire switch is configured to discharge the energy from the energy storage device in response to one or more discharge control signals.

9. The high voltage firing unit of claim 8, wherein the fire switch includes a switch selected from the group consisting of an electronic switch, a gap tube, and a triggered gap tube.

10. The high voltage firing unit of claim 1, wherein the lower voltage input signal is within a range between about 22V and 45V, and the high voltage output signal stored across one or more capacitors of the energy storage device for discharge is greater than about 500V.

11. The high voltage firing unit of claim 1, wherein the plurality of safety switches includes:

a first switch operably coupled in a path of the lower voltage input signal to a transfornier of the high voltage converter, wherein the first switch is a static switch controlled by an internal control signal from the control logic;

a second switch operably coupled in a path of a power return signal to the transformer of the high voltage converter; and a third switch operably coupled in the path of the power return signal to the transformer of the high voltage converter.

12. The high voltage firing unit of claim 11, wherein:

the first switch is a static switch controlled by an internal control signal from the control logic;

the second switch is a static switch controlled by the second electronic ESA power signal from the external ordnance controller; and the third switch is a dynamic switch that is enabled by another internal control signal from the control logic.

13. The high voltage firing unit of claim 1, wherein the high voltage converter and the control unit receive separate power signals such that the high voltage converter and the control unit are electrically isolated from each other.

14. The high voltage firing unit of claim 1, further comprising a safety plug configured to physically disconnect the first ESA power signal and a second ESA power signal.

15. An ordnance system, comprising:

a high voltage firing unit, comprising:

a high voltage converter configured to convert a low voltage signal to a high voltage output signal;

a capacitive discharge unit configured to store energy from the high voltage output signal in one or more energy storage devices, and to discharge the energy responsive to a fire control signal;

a control unit configured to control internal operations of the high voltage firing unit; and a plurality of switches operably coupled to a lower voltage side of the high voltage converter that is electrically isolated from the capacitive discharge unit; and an ordnance controller operably coupled with the high voltage firing unit, wherein the ordnance controller is configured to communicate data with the control unit and a first power signal and a second power signal to the high voltage converter, wherein each switch of the plurality of switches is controlled independently by one of the ordnance controller and the control unit, wherein the first power signal is the low voltage signal provided to a first safety switch coupled in the path to the capacitive discharge unit to selectively couple the low voltage signal to the capacitive discharge unit responsive to a control signal from the control unit.

16. The ordnance system of claim 15, wherein the ordnance controller is further configured to provide a third power signal to provide power to the control unit of the high voltage firing unit independently of the first power signal and the second power signal.

17. The ordnance system of claim 16, wherein the high voltage converter includes a third safety switch serially coupled with the second safety switch in the path to the capacitive discharge unit, wherein the third safety switch is configured as a dynamic switch to pulse charging of the energy storage device with the high voltage output signal responsive to another control signal generated by the high voltage converter.

18. The ordnance system of claim 16, wherein the control unit is configured to monitor the first power signal and the second power signal from the ordnance controller to determine whether the first power signal and the second power signal are each within a predetermined voltage band prior to enabling the first safety switch.

19. The ordnance system of claim 15, wherein the ordnance controller is configured to verify an address command received from a host controller with an address associated with the high voltage firing unit prior to arming the high voltage charging unit.

20. The ordnance system of claim 15, further comprising a plurality of high voltage firing units operably coupled with the ordnance controller with common cabling including power lines and communication lines to the plurality of high voltage firing units.

21. A method for operating a high voltage firing unit, the method comprising:

receiving a first arming power signal and a second arming power signal from an external ordnance controller;

arming a high voltage converter of a high voltage firing unit responsive to a plurality of safety switches being enabled on a lower voltage side of a transformer electrically isolated from a capacitive discharge unit of the high voltage firing unit, at least one safety switch of the plurality of safety switches in a path of the low voltage input signal to the transformer;

charging the capacitive discharge unit by converting the first arming power signal as a low voltage input signal to become a high voltage output signal and storing energy from the high voltage output signal in an energy storage device; and discharging the energy from the energy storage device to activate an initiator in response to a fire control signal.

22. The method of claim 21, further comprising determining a status of the high voltage firing unit by monitoring at least one of a voltage and a current measured at least one internal node of the high voltage firing unit.

23. The method of claim 22, wherein determining the status occurs during power up of a control and monitoring unit of the high voltage firing unit.

24. The method of claim 23, further comprising transmitting the status to the external ordnance controller prior to the external ordnance controller providing the first arming power signal to the high voltage converter.

25. The method of claim 21, wherein receiving the first arming power signal and the second arming power signal includes verifying that the second arming power signal is within a desired voltage band and informing the external ordnance controller prior to external ordnance controller sending the first arming power signal to the high voltage firing unit.

26. The method of claim 25, further comprising verifying that the first arming power signal is within a desired voltage band prior to enabling charging of the capacitive discharge unit.

* * * * *

UNITED STATES PATENT AND TRADEMARK OFFICE

CERTIFICATE OF CORRECTION

PATENT NO. : 9,115,970 B2
APPLICATION NO. : 13/608571
DATED : August 25, 2015
INVENTOR(S) : Derek R. DeVries et al.

It is certified that error appears in the above-identified patent and that said Letters Patent is hereby corrected as shown below:

In the specification:

COLUMN 10, LINE 37, change “an aiming” to --an arming--

In the claims:

CLAIM 11, COLUMN 12, LINE 55, change “to a transfornier” to --to a transformer--
CLAIM 22, COLUMN 14, LINE 33, change “measured at least” to --measured at at least--

Signed and Sealed this
Sixteenth Day of August, 2016

Michelle K. Lee

Michelle K. Lee
*Director of the United States Patent and Trademark Office*